United States Patent [19]

Schawann et al.

[11] Patent Number: 4,646,841

[45] Date of Patent: Mar. 3, 1987

[54] GUIDE TABLE FOR A MARINE PRODUCTION RISER

[75] Inventors: Jean C. Schawann, Idron; Jean P. Caumont, Pau; Jean Falcimaigne, Bois Colombes, all of France

[73] Assignee: Societe Nationale Elf Aquitaine (Production), France

[21] Appl. No.: 650,827

[22] Filed: Sep. 14, 1984

[30] Foreign Application Priority Data

Sep. 15, 1983 [FR] France ..... 83 14663

[51] Int. Cl.[4] ..... E21B 43/01

[52] U.S. Cl. ..... 166/355; 166/359

[58] Field of Search ..... 175/7, 8, 321, 10; 166/341, 342, 344, 345, 348, 349, 350, 355, 359; 405/195, 224

[56] References Cited

U.S. PATENT DOCUMENTS

| | | | |
|---|---|---|---|
| 3,308,881 | 3/1967 | Chan et al. | 166/344 X |
| 3,782,458 | 1/1974 | Slack | 166/355 |
| 4,053,022 | 10/1977 | Mercier | 175/7 |
| 4,095,649 | 6/1978 | Chateau et al. | 175/7 |
| 4,142,584 | 3/1979 | Brewer et al. | 166/359 |
| 4,444,275 | 3/1984 | Beynet et al. | 166/341 X |
| 4,527,928 | 7/1985 | Rutherford et al. | 405/195 X |

FOREIGN PATENT DOCUMENTS

| | | | |
|---|---|---|---|
| 113414 | 7/1983 | Japan | 405/195 |

*Primary Examiner*—James A. Leppink
*Assistant Examiner*—Matthew Smith
*Attorney, Agent, or Firm*—Poms, Smith, Lande & Rose

[57] ABSTRACT

A circular guide table is provided for a marine production riser comprising an opening for the central tube having a ball joint allowing angular movement of the tube in any direction with respect to the table and two radial arms offset from each other by an angle close to 90° fixed to the table and whose ends each support a sliding device, such as a roller carriage capable of sliding along vertical rails fixed to the platform. The table is formed from an inner collar in the form of a hub to which are fixed spokes between which the peripheral production stringers pass, the opposite ends of the spokes being joined together by an external collar provided with radial arms.

1 Claim, 2 Drawing Figures

GUIDE TABLE FOR A MARINE PRODUCTION RISER

BACKGROUND OF THE INVENTION

The present invention relates to a device for guiding the head element of the central tube of a production riser supported by a surface structure of the semi submersible platform type and more particularly to a guide table fixed to the upper part of the central tube. Usually, the central tube of the production riser, often accompanied by a peripheral production string assembly, is suspended by means of a tensioning member from a semi submersible platform, which is subjected to the effects due to the different movements of the sea and transmits them to the head of the central tube, whose horizontal and angular movements may thus reach high values.

SUMMARY OF THE INVENTION

The aim of the present invention is to reduce or eliminate such movements by means of a guide table carried by to the upper part of the central tube of a production riser, wherein the circular table comprises an opening for the central tube, said tube being provided with a hinge joint or ball and socket joint allowing angular movement in any direction of the tube with respect to the table and at least two radial arms offset by an angle less than 180°, fixed to the table and whose ends each carry a device sliding along vertical rails integral with the platform.

Each sliding device may be formed advantageously by a roller carriage adapted for travelling over a travel path formed by the profile of said rail.

Preferably, the arms are two in number, offset from each other by an angle close to 90°.

In an advantageous variant, the table is formed from an inner collar in the form of a hub to which spokes are fixed, between which the peripheral stringers of the production riser pass, the opposite ends of the spokes being joined together by an external collar having radial arms, whose ends are provided with sliding devices. The inner collar may comprise a bushing whose bearing face in the form of a spherical skull cap forms the rotation seat for the ball joint integral with the central tube.

BRIEF DESCRIPTION OF THE DRAWINGS

Other features of the guide table will appear from the following description of one embodiment illustrated by the drawings, in which.

Figure 1:
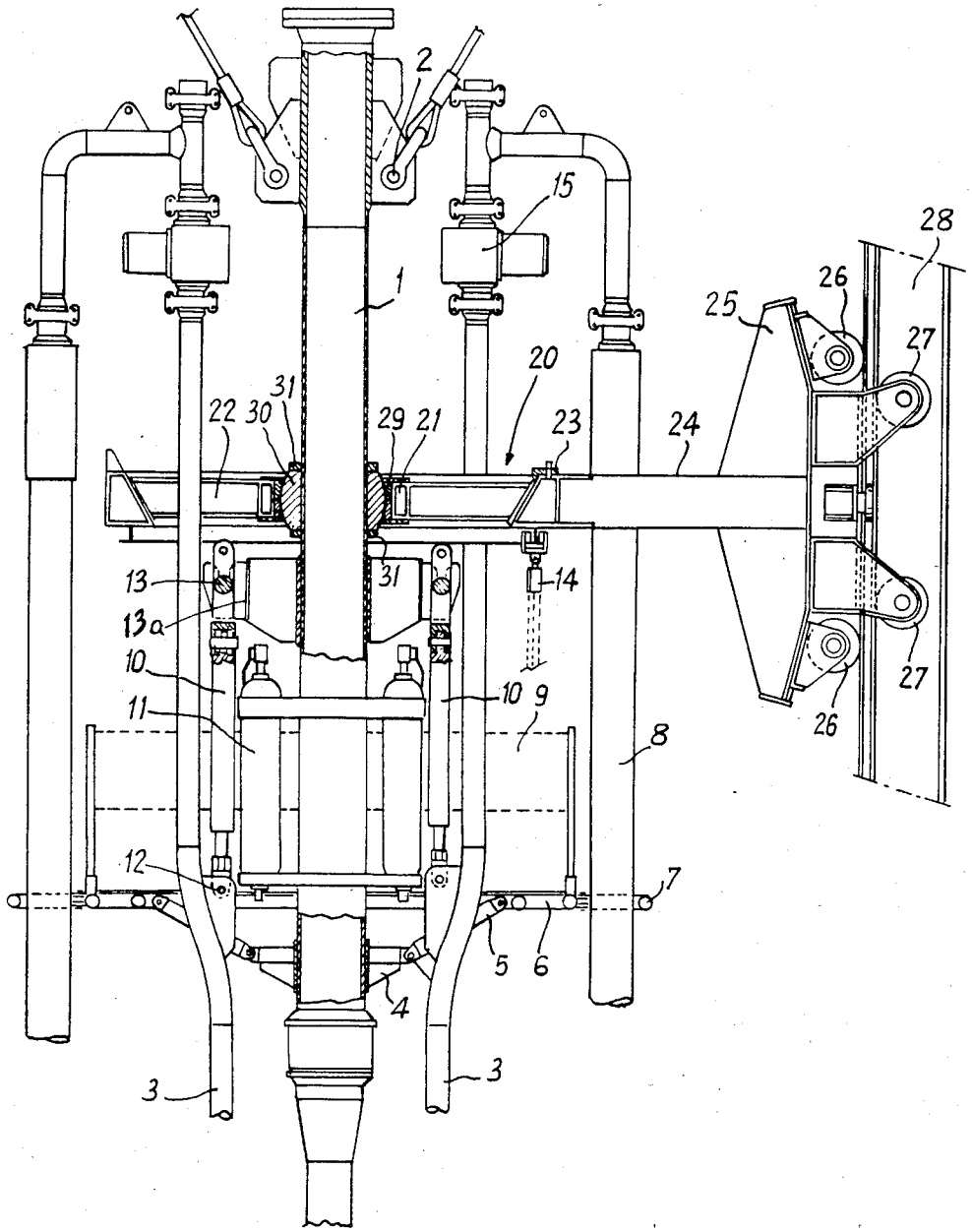
FIG. 1 is a view in vertical section through A—A of FIG. 2.
Figure 2:
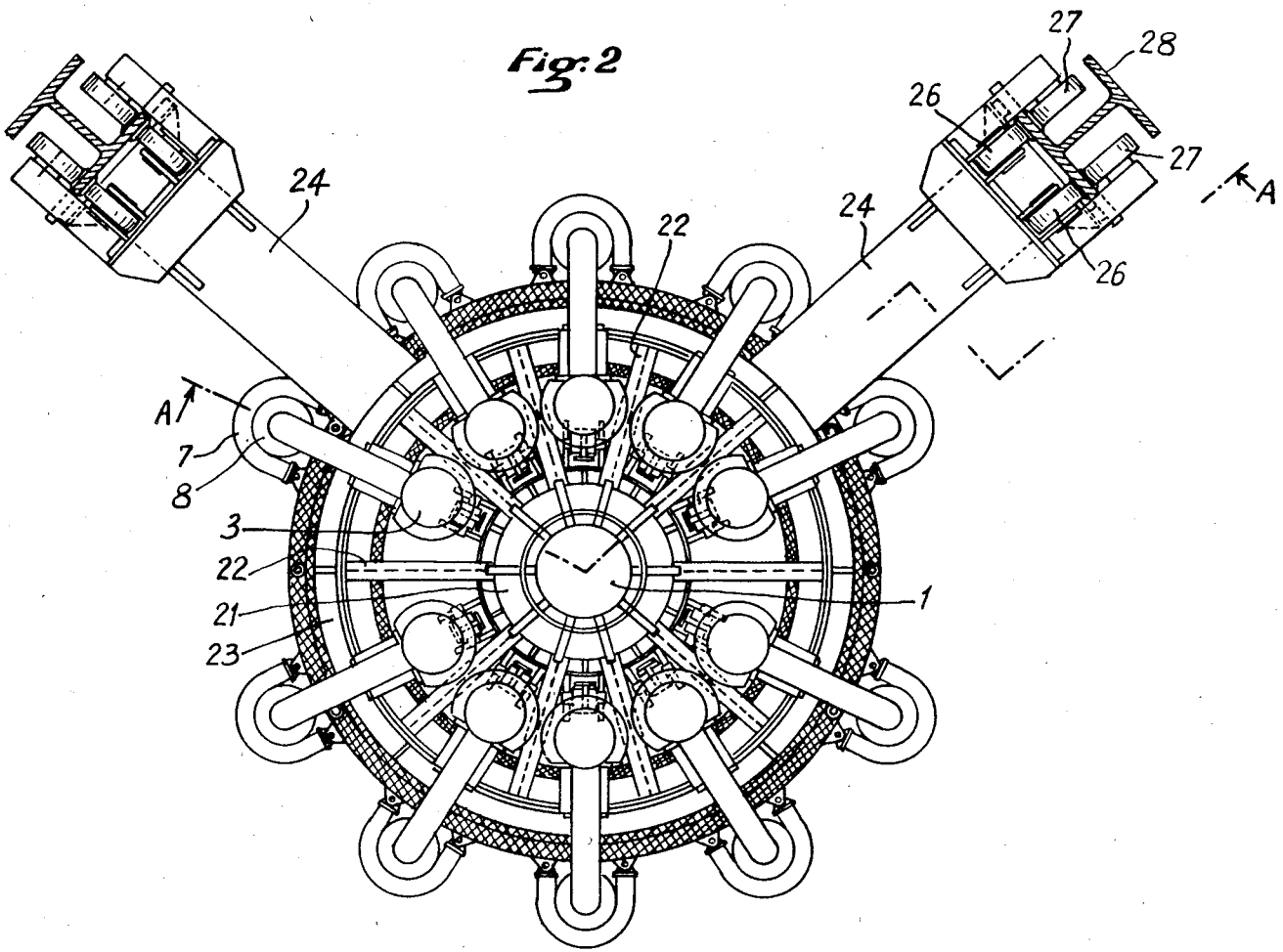
FIG. 2 is a top view of the installation.

In the accompanying Figures is shown a head element of a production riser comprising a central tube 1 suspended at 2 from a semi submersible platform by means of tensioning devices (not shown) and surrounded by peripheral production stringers 3 having isolating valves 15 or flow nozzles. Guide table 20 is formed from a central inner collar 21 in the form of a hub to which spokes 22 are fixed between which the peripheral stringers 3 pass in spaced relation thereto as shown in FIG. 2.

The tensioning of each peripheral stringer 3 is provided by means of hydraulic cylinders 10 which work under traction, coupled to oleo-pneumatic accumulators 11. The ends of each cylinder are supported by shafts 12 and 13 integral respectively with each peripheral stringer and the central tube. Each stringer 3 is connected at 12 to one end of hydraulic cylinder 10, the other end of the cylinder being connected to shaft 13 which is connected to the central tube by the structure **13*a* shown below the lower shrunk fit ring 31. Hydraulic cylinder 10 tensions the stringers 3 and vertical relative movement is provided at the locations where the peripheral stringers 3 pass between the spokes 22. The stringers 3 are provided some movement with the central tube 1 and are not laterally restrained by the inner and outer collars 21, 23 and the spokes 22 therebetween. It should be noted that shaft 13 provides pivotal movement of cylinder 10 relative to tube 1, shaft 12 provides pivotal movement of stringer 3 relative to cylinder 10, valve 15 is supported by stringer 3, and the hoses 8 are flexible and loosely confined within the rings 7. Thus, the structure described from the shaft 13 to shaft 12 to stringer 3 to the space between the spokes 22 and inner and outer collars through which the stringers pass, the flexible hose 8 and the loose confinement ring 7 provide an upper structure which allows lateral movement with changes of movement of the central tube 1** about its rotational seat. The arrangement of the table in the form of spokes as well as the device for tensioning the peripheral stringers bearing on the central tube, greatly facilitate the positioning and tensioning of the peripheral stringers at the head of the installation comprising the guide table of the invention.

Coupling arms 4 integral with the central tube 1 are provided with links 5 to which is fixed a circular walk way 6 provided with a guard rail 9. The flexible pipes 8 connecting the peripheral stringers 3 to a processing unit situated on the platform, not shown, are secured to the walk way by means of holding rings or collars 7.

Hoisting gear 14 fixed to the structure of the walk way completes the installation. The opposite ends of spokes 22 made from metal sections are joined together by an outer collar 23, also made from metal sections, to which two radial arms 24 offset from each other by an angle close to 90° are fixed by bolts or welding. Other means for fixing the radial arms may be considered, for example radial arms integral with a collar which, having a truncated cone shaped bearing surface, would fit onto the corresponding truncated cone shaped bearing surface of the outer collar 23.

Each free end of arm 24 supports a carriage 25 having two pairs of rollers 26 and 27. A vertical rail 28 of H section integral with the platform serves as travel a guide path for carriage 25 and more especially in such a way that a pair of rollers 26 and 27 situated on each side grips a flange of section 28.

The roller sliding device may be replaced by any other device, for example by a device with shoes.

The inner collar 21 of the table has in the middle thereof a bushing 29 whose spherical skull cap shaped bearing surface forms the rotation seat for a ball joint 30 secured to the central tube 1 by means of rings 31 shrunk fit on the tube.

The effects of a relative movement of the platform on the central tube are reduced or practically disappear by using the device of the invention.

In fact, with the sliding devices 25, with which the radial arms 24 offset from each other by an angle less than a 180° are provided and with the arrangement of two parallel vertical rails integral with the platform, the rotational seat of the central tube is permanently at an equal distance from the rails, limiting the amplitude of the movements. The angular offset of the radial arms, preferably by an angle close to 90°, frees the remaining 270° so as to facilitate access of handling and lifting means to the different mechanical parts of the device.

What is claimed is:

1. Apparatus for reducing or eliminating transmittal of wave and wind induced motions of a semi-submersible platform to an upper part of a central tube having a vertical axis of a production riser system which also includes peripheral riser stringers, comprising in combination:

guide means for the upper portion of the riser system;

said guide means including inner and outer concentric collars interconnected by spaced radial spokes defining openings for lateral restraint-free passage therethrough of said peripheral riser stringers;

the upper part of the central tube passing through said inner collar;

ball joint means secured to the upper central tube part and secured to the inner collar to provide a rotational seat for relative angular movement of the central tube part in any direction with respect to said inner and outer collar and interconnecting spokes;

means connected to the central tube above the inner collar for suspending the guide means from the platform;

and means limiting amplitude of movement of the central tube at said rotational seat including a pair of guide arms extending from said outer collar in angular relation of less than 180°, each having an arm end, vertical track means carried by the platform opposite the end of each guide arm, and a carriage at the end of each arm having means slidably engaged with the track means for limiting the amplitude of movement of the central tube and thereby reducing transmittal of motion from the platform to said central tube.

* * * * *